US005821216A

United States Patent [19]

Cala et al.

[11] Patent Number: 5,821,216

[45] Date of Patent: Oct. 13, 1998

[54] CARBONATE BUILT LAUNDRY DETERGENT COMPOSITION

[75] Inventors: Francis R. Cala, Highland Park, N.J.; Charles D. Carr, Yardley, Pa.; Bruce R. Conley, Hamilton, N.J.

[73] Assignee: Church & Dwight Co., Inc., Princeton, N.J.

[21] Appl. No.: 837,575

[22] Filed: Apr. 21, 1997

[51] Int. Cl.[6] ..... C11D 1/14; C11D 1/72; C11D 3/10

[52] U.S. Cl. ..... 510/509; 510/276; 510/289; 510/290; 510/318; 510/340; 510/351; 510/356; 510/357; 510/359; 510/361; 510/446; 510/452; 510/453; 510/477; 510/478

[58] Field of Search ..... 510/276, 289, 510/290, 318, 340, 351, 356, 357, 359, 361, 446, 452, 453, 477, 478, 509

[56] References Cited

U.S. PATENT DOCUMENTS

| | | | |
|---|---|---|---|
| 4,062,647 | 12/1977 | Storm et al. | 8/137 |
| 4,265,790 | 5/1981 | Winston et al. | 252/532 |
| 4,464,292 | 8/1984 | Lengyel | 252/532 |
| 5,376,300 | 12/1994 | Bolkan et al. | 252/174.14 |
| 5,391,326 | 2/1995 | Smith et al. | 252/559 |
| 5,482,646 | 1/1996 | Mazzola | 252/174.13 |

*Primary Examiner*—Paul Lieberman
*Assistant Examiner*—Charles Boyer
*Attorney, Agent, or Firm*—Irving Fishman

[57] ABSTRACT

Carbonate built laundry detergents having improved cleaning properties and comprising a sulfated ethoxylated fatty alcohol anionic surfactant and two ethoxylated fatty alcohol nonionic surfactants having different average numbers of carbon atoms in the fatty alcohol and average numbers of ethoxy groups.

12 Claims, No Drawings

CARBONATE BUILT LAUNDRY DETERGENT COMPOSITION

BACKGROUND OF THE INVENTION

1. Field of the Invention

This invention relates to novel laundry detergent compositions having a high water-soluble alkaline carbonate builder content, the use of which results in improved cleaning performance.

2. Background Information Including Description of Related Art

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

While laundry detergents containing a relatively large amount of carbonate builder are generally quite satisfactory in their cleaning ability, there exist situations wherein even better performance in the removal of certain types of soils comprising oily particulates and fatty deposits such as sebum, would be advantageous. Thus, any change in available carbonate built laundry detergent compositions which improves their ability to remove such soils is highly desirable.

Possibly relevant to the invention claimed herein are U.S. Pat. Nos. 4,265,790, issued May 5, 1981 to Winston et al.; 4,464,292, issued Aug. 7, 1984 to Lengyel; and 5,376,300 issued Dec. 27, 1994 to Bolkan et al., each of which discloses detergent compositions comprising an ethoxylated long chain alcohol and a sulfate of an ethoxylated long chain alcohol as a combination of nonionic and anionic surfactants, and over 70 wt % of anhydrous sodium carbonate (soda ash) as a detergent builder.

SUMMARY OF THE INVENTION

In accordance with this invention, a laundry detergent composition is provided wherein the solids content comprises at least about 60 wt. % of a water soluble alkaline carbonate builder; about 1.5 to about 10 wt. % of a first ethoxylated fatty alcohol nonionic surfactant, wherein the fatty alcohol is a $C_{12}$ or $C_{13}$ single alcohol, or a mixture of alcohols containing predominantly 12 to 13 carbon atoms, with an average of about 12.0 to about 13.0 carbon atoms, and the average number of ethoxy groups is about 1.0 to about 3.5; about 1 to about 10 wt % of a second ethoxylated fatty alcohol nonionic surfactant, wherein the fatty alcohol is a mixture of alcohols containing predominantly 12 to 14 carbon atoms with an average of about 13.0 to about 13.8 carbon atoms and the average number of ethoxy groups is about 4 to about 7; and about 1.0 to about 10.0 wt % of a sulfated ethoxylated fatty alcohol anionic surfactant, wherein the fatty alcohol is a $C_{12}$ or $C_{13}$ single alcohol or a mixture of a alcohols containing predominantly 12 and 13 carbon atoms with an average of about 12 to about 13 carbon atoms, and the average number of ethoxy groups is about 1.0 to about 3.5.

It has been found that the detergent compositions of this invention containing the specified second nonionic surfactant has an improved ability to remove soils caused by certain oily or fatty deposits, as compared with detergent compositions not containing such second nonionic surfactant.

DETAILED DESCRIPTION OF THE INVENTION

The water-soluble alkaline carbonate builder in the detergent composition of this invention may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of at least about 60 wt. %, preferably about 70 to about 85 wt. %. If a combination of alkali metal carbonate and bicarbonate is used as the water-soluble carbonate, then the alkali metal carbonate, e.g., sodium carbonate, is preferably used in an amount of about 70 to about 84 wt. % and the alkali metal bicarbonate, e.g., sodium bicarbonate, in an amount of about 1 to about 15 wt. %. All the foregoing percentages are based on the weight of total solids in the composition.

The fatty alcohol of the first ethoxylated fatty alcohol nonionic surfactant in the detergent compositions of the invention is a single $C_{12}$ or $C_{13}$ alcohol, or a mixture of alcohols, preferably linear (straight chain) primary or secondary monohydric alcohols containing predominantly 12 to 13 carbon atoms, with an average which is about 12.0 to about 13.0 carbon atoms, preferably about 12.2 to about 12.7 carbon atoms, while the average number of ethoxy groups in said surfactant is about 1.0 to about 3.5, preferably about 2.5 to about 3.3. The first ethoxylated fatty alcohol nonionic surfactant may be present in the detergent composition in an amount of about 1.5 to about 10 wt. %, preferably about 2.0 to about 5.0 wt. % based on the total weight of solids in the composition.

The fatty alcohol of the second ethoxylated fatty alcohol nonionic surfactant in the detergent composition of the invention is a mixture of alcohols, preferably linear (straight chain) primary or secondary monohydric alcohols, containing predominantly 12 to 14 carbon atoms, with an average which is about 13.0 to about 13.8 carbon atoms, preferably about 13.2 to about 13.7 carbon atoms, while the average number of ethoxy groups in said surfactant is about 4 to about 7, preferably about 4.1 to about 6. The second ethoxylated fatty alcohol nonionic surfactant may be present in the detergent composition in an amount of about 1 to about 10 wt. %, preferably about 1 to about 6.7 wt. % based on the total weight of solids in the composition.

The fatty alcohol of the sulfated ethoxylated fatty alcohol anionic surfactant in the detergent composition of the invention is a single alcohol or mixture of alcohols, preferably linear (straight chain) primary or secondary monohydric alcohols, containing predominantly 12 to 13 carbon atoms, with an average which is about 12 to about 13 carbon atoms, preferably about 12.2 to about 12.7 carbon atoms while the average number of ethoxy groups in the anionic surfactant is in the range of about 1.0 to about 3.5, preferably about 2 to about 3.3. The sulfated ethoxylated fatty alcohol anionic surfactant may be present in the detergent composition in an amount of about 1.0 to about 10.0 wt. %, preferably about 2.7 to about 7.5 wt. % based on the total weight of solids in the composition.

The first ethoxylated fatty alcohol nonionic surfactant and the sulfated ethoxylated fatty alcohol anionic surfactant present in the detergent compositions of this invention as described previously may be advantageously produced by partially sulfating a batch of said first nonionic surfactant to an extent such that a mixture of anionic sulfated and nonionic unsulfated surfactants is produced which when compounded with the other components of the detergent composition yields a composition containing percentages of first nonionic surfactant and anionic surfactant within the ranges described previously for each surfactant. A process for thus preparing a mixture of first nonionic and anionic surfactants by partially sulfating a batch of first nonionic surfact is disclosed in previously cited U.S. Pat. No. 4,464,292 of Lengyel.

In addition to the necessary components described previously, the detergent compositions of the invention may optionally contain a phosphorus-containing sequestering agent which may be, for example, an inorganic phosphate, e.g., a soluble orthophosphate, metaphosphate, pyrophosphate or preferably a polyphosphate, such as an alkali metal phosphate of the type delineated, preferably a sodium or potassium tripolyphosphate. Organic phosphonates may also be employed as the phosphorus containing sequestering agent, particularly aminoethylenephosphonates (e.g., sold by Monsanto Company under the trademark "DEQUEST"), such as aminotri(methylenephosphonic acid) (ATMP), ethylenediaminetetra(methylenephosphonic acid) (EDTMP), hexamethylenediaminetetra (methylenephosphonic acid) (HMDTMP), and diethylenetriaminepenta(methylenephosphonic acid) (DETPMP). The most preferred phosphorus-containing sequestering agent is sodium tripolyphosphate (STPP).

The phosphorus-containing sequestering agent may be present in the detergent composition in an amount, for example, of about 0.1 to 3.0 wt. %, preferably about 0.2 to 2.5 wt. % based on the total solids in the composition.

The composition may also optionally contain as a soil antiredeposition agent a carboxylic acid-containing polymer which is a homopolymer or copolymer (composed of two or more comonomers) of an alpha, beta-monoethylenically unsaturated carboxylic acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the carboxlic acid containing polymer is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-monoethylenically unsaturated monomer which may be either non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., a copolymer of acrylic acid and acrylamide by partially hydrolyzing a polyacrylamide.

A copolymer of at least one unsaturated carboxylic acid monomer with at least one non-carboxylic comonomer should contain at least about 50 mol % of polymerized carboxylic acid monomer.

The carboxylic acid-containing polymer should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions.

The carboxylic acid-containing polymer may be present in the detergent composition in an amount of about 0.1 to 2 wt. %, preferably about 0.1 to 1.5 wt. % based on the total solids in the composition.

The detergent composition of this invention is preferably a solid dry-appearing powder, in which case water may be present in an amount, for example, of about 1–12 wt. %, preferably about 2–10 wt. %, based on the total weight of the composition.

The laundry detergent compositions of this invention may also contain various adjuvants common to detergent formulations such as brighteners, enzymes, carboxymethylcellulose, perfumes, dyes and peroxide generating persalts.

The following examples further illustrate the invention. The soil-removing results shown in the table for each of the following groups of examples were obtained as a separate unitary series.

EXAMPLES 1 AND 2 AND COMPARATIVE EXAMPLE A

In this group of examples, the soil-removing properties with respect to certain types of soilings were determined for various detergent compositions under the invention (Examples 1 and 2) as compared with a control composition (Comparative Example A) which was identical to the compositions under the invention except for the absence of the second ethoxylated fatty alcohol nonionic surfactant as defined previously.

In Comparative Example A (High Ash Test LD Base), the control base detergent composition consisted of about 65 grams of sodium carbonate, about 0.95 gram of sodium bicarbonate, an active surfactant consisting of about 5.7 grams of the sodium salt of sulfated predominantly $C_{12}$ and $C_{13}$ fatty alcohols with an average of 12.5 carbon atoms, ethoxylated with 3 moles of ethylene oxide per mole of alcohol (anionic surfactant) and about 3 grams of unsulfated predominantly $C_{12}$ and $C_{13}$ fatty alcohols having an average of about 12.5 carbon atoms ethoxylated with 3 moles of ethylene oxide per mole of alcohol (nonionic surfactant); about 1.4 gram of sodium tripolyphosphate (STPP); about 0.61 gram on a dry basis of the sodium salt of a polymeric blend of 50 wt. % of a polyacrylic acid having a number average molecular weight of about 4500, and 50 wt. % of a copolymer of 50:50 acrylic and methacrylic acids having a number average molecular weight of 3500; about 0.21 gram on a dry basis of carboxymethylcellulose (CMC); about 0.2 gram of an optical brightener; and about 7.9 grams of water.

The composition of Example 1 was the same as that of comparative Example A except that it contained an additional 4 grams of a second ethoxylated fatty alcohol nonionic surfactant, wherein predominantly $C_{12}$ and $C_{14}$ fatty alcohols with an average of about 13.2 carbon atoms were ethoxylated with about 5 moles of ethylene oxide per mole of fatty alcohol.

In Example 2, the detergent composition was the same as in Example 1 except that the second nonionic surfactant consisted of the same fatty alcohols ethoxylated with about 7 rather than 5 moles of ethylene oxide per mole of alcohol.

Following the procedure of ASTM D-3050 utilizing full size Whirlpool washing machines, various swatches of cotton and poly/cotton (a blend of 65 wt. % cotton and 35 wt. % polyester) soiled with various substances, were washed at 95° F. with the wash water containing 100 ppm of calcium and magnesium hardness with a Ca/Mg molar ratio of 3:1, such hardness calculated as $CaCO_3$ as described in ASTM D 1126-86 of October 1986. Four replicate soiled swatches were used for each determination, two in each of two machines. Reflectances of the clean unsoiled samples, the soiled samples and the washed samples were measured using a standard spectrophotometer, and the percent soil removal was calculated from the spectrophotometer measurements. The average percent soil removal for the various types of soiled samples are shown in Table I wherein "EMPA 101" indicates a soil of carbon black and olive oil on cotton, and "EMPA 104" indicates a soil of carbon black and olive oil on poly/cotton. Results obtained with these soilings and those of sebum on cotton and poly/cotton are an excellent indication of the cleaning power of a detergent composition. The acronym "EMPA" stands for "Eldgenossiche Materials Prufungs Anstalt", a Swiss government testing center.

In Tables I, II and III of this specification, an asterisk (*) has been placed near the value of each percent soil removal obtained with a detergent composition under the invention which represents a statistically significant difference from the corresponding value obtained with the control composition, such difference having been determined in accordance with least significant differences (LSD) as derived from a utilization of one way analysis of variance (ANOVA) per Statgraphics software package. The values of percent soil removal which do not have an asterisk are considered to be statistically equivalent to the values obtained with the corresponding control compositions.

TABLE I

| | Example | | |
|---|---|---|---|
| Soiled Sample | A (control) | 1 | 2 |
| Sebum on Cotton | 53.2 | 60.7* | 58.9* |
| EMPA 101 | 39.2 | 43.2* | 43.6* |
| Sebum on Poly/Cotton | 78.3 | 80.5* | 79.7 |
| EMPA 104 | 30.7 | 35.8* | 37.3* |

EXAMPLES 3 AND 4 AND COMPARATIVE EXAMPLE B

In these examples, the procedure of the previous examples was followed for a somewhat different profile of detergent compositions.

In Comparative Example B, the same control composition was used as in Comparative Example A.

The composition of Example 3 was the same as that of Examples 1 and 2 except that the second nonionic surfactant consisted of the same fatty alcohols ethoxylated with about 4.3 moles of ethylene oxide per mole of alcohol.

In Example 4, the detergent composition was the same as in Example 2. Results are shown in Table II.

TABLE II

| | Example | | |
|---|---|---|---|
| Soiled Sample | B (control) | 3 | 4 |
| Sebum on Cotton | 47.8 | 51.5 | 52.1 |
| EMPA 101 | 37.1 | 39.4 | 39.5 |
| Sebum on Poly/Cotton | 65.7 | 68.0 | 67.9 |
| EMPA 104 | 28.3 | 32.2* | 30.7 |

EXAMPLES 5 AND 6 AND COMPARATIVE EXAMPLE C

In this group of examples, the procedure of the previous examples was generally followed with the compositions of Examples 5 and 6 and Comparative Example C being the same as the compositions of Examples 3 and 4 and Comparative Example B, respectively except that they each contained only 45 grams (Low Ash Test LD Base) rather than 65 grams of sodium carbonate. The results are shown in Table III.

TABLE III

| | Example | | |
|---|---|---|---|
| Soiled Sample | C (control) | 5 | 6 |
| Sebum on Cotton | 48.7 | 54.2* | 51.3 |
| EMPA 101 | 37.5 | 41.9* | 42.5* |
| Sebum on Poly/Cotton | 63.8 | 67.6* | 67.6* |
| EMPA 104 | 28.5 | 33.0* | 30.4 |

EXAMPLES 7–9'

The procedure of the previous examples was generally followed with the control composition being the same as that of Comparative Examples A and B containing 65 grams of sodium carbonate, and the compositions of Examples 7, 8 and 9 being the same as those of Examples 1, 3 and 2 respectively. Examples 8' and 9' were repetitions of the soil-removing determinations of the compositions of Examples 8 and 9 respectively. The results are shown in Table IV, which, unlike those of the previous tables show the difference between the percent of soil-removal obtained for each composition and that obtained with the control composition, with a positive number indicating a higher percentage and a negative number a lower percentage of soil-removal, than that obtained with the control composition.

In Tables IV, V and VI, an asterisk (*) has been placed near each value of difference when such difference has been determined to be statistically significant in accordance with the procedure described in the paragraph preceding Table I, for the soil removal values in Tables I, II and III. Such values of difference which do not have an asterisk are believed to be statistically equivalent to zero (no difference) in accordance with the described procedure for determining statistical significance.

TABLE IV

| Soiled Sample | Example 7 | 8 | 8' | 9 | 9' |
|---|---|---|---|---|---|
| Sebum on Cotton | +3 | +3.7 | +5.6* | +4.3 | +4.5* |
| EMPA 101 | +4.2 | +2.3 | +0.1 | +2.4 | −1.4 |
| Sebum on poly/Cotton | +3.5* | +2.3 | +4.6* | +2.2 | +3.7* |
| EMPA 104 | +3.5* | +3.9* | +0.5 | +2.4 | −1.2 |

EXAMPLES 10–12'

The procedure of the previous examples was followed with the control composition and the compositions of Examples 10–12 being the same as the control composition and the compositions of Examples 7–9 respectively except that the compositions each contained 45 grams rather than 65 grams of sodium carbonate. Examples 11' and 12' were repetitions of the soil removal determinations of the compositions of Examples 11 and 12 respectively. The results in terms of the differences between the soil removal percentages of the compositions of the examples and those of the control composition are shown in Table V.

TABLE V

| Soiled Sample | Example 10 | 11 | 11' | 12 | 12' |
|---|---|---|---|---|---|
| Sebum on Cotton | +3.4* | +5.5* | +5.8* | +2.6 | +6.0* |
| EMPA 101 | +2.2 | +4.4* | +2 | +5.0* | +2.2 |
| Sebum on Poly/Cotton | +4.3* | +3.8* | +4.1* | +3.8* | +1 |
| EMPA 104 | +2.5 | +4.5* | +3.6* | +1.9 | +2.5 |

The results of Examples 1 to 12' show that the addition of a second ethoxylated nonionic surfactant under the invention to a standard control composition containing 65 or 45 grams of sodium carbonate and a constant amount of a conventional first ethoxylated fatty alcohol surfactant, often resulted in a statistically significant improvement in the EMPA 101 and EMPA 104 soil-removing properties of the composition and/or an improvement in the sebum on cotton and/or poly/cotton soil-removing properties of the composition. Furthermore, there were no statistically significant reductions of these soil-removing properties in any of the examples.

COMPARATIVE EXAMPLES D, D', E AND E'

These comparative examples are for the purpose of showing that the improvements in the soil removing properties of the compositions of Examples 1 to 12' under the invention were not due merely to the increased amount of nonionic surfactant present in these composition as compared with the control compositions, but were rather due to the specific nature of the second nonionic surfactant added in those examples. Thus, in these comparative examples, four additional grams of the nonionic surfactant present in the control compositions of the previous examples as described in comparative Example A, which was the same as the first nonionic surfactant present in Examples 1 to 12' under the invention, were added to such control compositions and the soil-removing properties of the resulting compositions, which now contained the same amount (7 grams) of nonionic surfactant as the inventive compositions of Examples 1 to 12', were determined as described in the previous examples. The composition of Comparative Examples D and its repetition D', and their control composition (which was the same as that of comparative Examples A and B) contained 65 grams of sodium carbonate, while the a composition of Comparative Examples E and its repetition E' and their control composition (which was the same as that of Comparative Example C) contained 45 grams of sodium carbonate. Results in terms of the difference between the percentages of soil removed by the tested composition and the control composition, are shown in Table VI.

TABLE VI

| Soiled Sample | Example D | D' | E | E' |
|---|---|---|---|---|
| Sebum on Cotton | +0.6 | +5.0* | +3.5 | +6.7* |
| EMPA 101 | +1.2 | −1.9 | +3.0 | +1.0 |
| Sebum on Poly/Cotton | +1.7* | +1.7* | +1.6 | +2.0* |
| EMPA 104 | +0.1 | −2.2 | +0.6 | −1.3 |

The results of these examples show that there were no statistically significant difference between the EMPA 101 and 104 soil removal properties of the tested compositions, which contained the same amount of both anionic and nonionic surfactants as those of Examples 1 to 12' under the invention, and such properties of the control compositions. This proves that with respect to these soilings, the superior performance of the inventive compositions is due to the specific nature of the second nonionic surfactant present rather than to the total amount of nonionic surfactant present.

We claim:

1. A laundry detergent composition wherein the solids content comprises at least about 60 wt. % of a water soluble alkaline carbonate builder; about 1.5 to about 10 wt. % of a first ethoxylated fatty alcohol nonionic surfactant, wherein the fatty alcohol is a single $C_{12}$ or $C_{13}$ alcohol or a mixture of alcohols containing predominantly 12 to 13 carbon atoms, with an average of about 12.0 about 13.0 carbon atoms, and the average number of ethoxy groups is about 1.0 to about.3.5; about 1 to about 10 wt. % of a second ethoxylated fatty alcohol nonionic surfactant, wherein the fatty alcohol is a mixture of alcohols containing predominantly 12 to 14 carbon atoms with an average of about 13.0 to about 13.8 carbon atoms and the average number of ethoxy groups is about 4 to about 7; and about 1.0 to about 10.0 wt. % of a sulfated ethoxylated fatty alcohol anionic surfactant, wherein the fatty alcohol is a $C_{12}$ or $C_{13}$ single alcohol or a mixture of a alcohols containing predominantly 12 to 13 carbon atoms with an average of about 12 to about 13 carbon atoms, and the average number of ethoxy groups is about 1.0 to about 3.5, all percentages based on the total weight of solids in the composition.

2. The composition of claim 1 wherein said alkaline carbonate is sodium carbonate.

3. The composition of claim 2 wherein said sodium carbonate is present in an amount of about 70 to about 84 wt. %.

4. The composition of claim 3 which also comprises about 1 to about 15 wt. % of sodium bicarbonate.

5. The composition of claim 1 wherein said first nonionic surfactant consists of a mixture of fatty alcohols having an average of about 12.2 to about 12.7 carbon atoms ethoxylated with an average of about 2.5 to about 3.3 ethoxy groups, and is present in an amount of about 2.0 to about 5.0 wt. %.

6. The composition of claim 1 wherein said second nonionic surfactant is one or more fatty alcohols having an average of about 13.2 to about 13.7 carbon atoms ethoxylated with an average of about 4.1 to about 6 ethoxy groups, and is present in an amount of about 1 to about 6.7 wt. %.

7. The composition of claim 1 wherein said anionic surfactant is a mixture of sulfated fatty alcohols having an average of about 12.2 to about 12.7 carbon atoms ethoxylated with an average of about 2.0 to about 3.3 ethoxy groups, and is present in an amount of about 2.7 to about 7.5 wt. %.

8. The composition of claim 1 also containing a phosphorus-containing sequestering agent.

9. The composition of claim 8 wherein said sequestering agent is sodium tripolyphosphate (STPP) which is present in an amount of about 0.1 to about 3.0 wt. %.

10. The composition of claim 1 also comprising a carboxylic acid-containing polymer of at least 50 mol % of an ethylenically unsaturated caraboxylic acid monomer as a soil antiredeposition agent.

11. The composition of claim 10 wherein said polymer is present in an amount of about 0.1 to about 2 wt. %.

12. The composition of claim 1 which is in the form of a dry appearing powder and also contains about 1 to about 12 wt. % of water based on the total weight of the composition.

* * * * *